US009466887B2

(12) United States Patent
Gregoire et al.

(10) Patent No.: US 9,466,887 B2
(45) Date of Patent: Oct. 11, 2016

(54) LOW COST, 2D, ELECTRONICALLY-STEERABLE, ARTIFICIAL-IMPEDANCE-SURFACE ANTENNA

(71) Applicant: HRL Laboratories, LLC, Malibu, CA (US)

(72) Inventors: Daniel J. Gregoire, Thousand Oaks, CA (US); Joseph S. Colburn, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 641 days.

(21) Appl. No.: 13/934,553

(22) Filed: Jul. 3, 2013

(65) Prior Publication Data

US 2015/0009070 A1 Jan. 8, 2015

(51) Int. Cl.

| | |
|---|---|
| ***H01Q 3/00*** | (2006.01) |
| ***H01Q 15/00*** | (2006.01) |
| ***H01Q 3/46*** | (2006.01) |

(52) U.S. Cl.

CPC ..... *H01Q 15/0066* (2013.01); *H01Q 3/46* (2013.01)

(58) Field of Classification Search

CPC ..... H01Q 3/00; H01Q 15/0066; H01Q 3/46
USPC ..... 342/372, 368
See application file for complete search history.

(56) References Cited

U.S. PATENT DOCUMENTS

| | | | |
|---|---|---|---|
| 3,267,480 | A | 8/1966 | Lerner |
| 3,560,978 | A | 2/1971 | Himmel |
| 3,810,183 | A | 5/1974 | Krutsinger et al. |
| 3,961,333 | A | 6/1976 | Purinton |
| 4,045,800 | A | 8/1977 | Tang et al. |
| 4,051,477 | A | 9/1977 | Murphy et al. |
| 4,087,822 | A | 5/1978 | Maybell |
| 4,119,972 | A | 10/1978 | Fletcher et al. |
| 4,123,759 | A | 10/1978 | Hines et al. |
| 4,124,852 | A | 11/1978 | Steudel |

(Continued)

FOREIGN PATENT DOCUMENTS

| | | |
|---|---|---|
| DE | 196 00 609 | 4/1997 |
| EP | 0 539 297 | 4/1993 |

(Continued)

OTHER PUBLICATIONS

From PCT Application No. PCT/US2013/050412, Chapter I, International Preliminary Report on Patentability (IPRP) mailed on Jan. 14, 2016.

(Continued)

*Primary Examiner* — Harry Liu
(74) *Attorney, Agent, or Firm* — Ladas & Parry

(57) ABSTRACT

A steerable artificial impedance surface antenna steerable in phi and theta angles including a dielectric substrate, a plurality of metallic strips on a first surface of the dielectric substrate, the metallic strips spaced apart across a length of the dielectric substrate and each metallic strip extending along a width of the dielectric substrate, and surface wave feeds spaced apart along the width of the dielectric substrate near an edge of the dielectric substrate, wherein the dielectric substrate is substantially in an X-Y plane defined by an X axis and a Y axis, wherein the phi angle is an angle in the X-Y plane relative to the X axis, and wherein the theta angle is an angle relative to a Z axis orthogonal to the X-Y plane.

26 Claims, 7 Drawing Sheets

(56) References Cited

U.S. PATENT DOCUMENTS 4,127,586 A 11/1978 Rody et al.
4,150,382 A 4/1979 King
4,173,759 A 11/1979 Bakhru
4,189,733 A 2/1980 Malm
4,217,587 A 8/1980 Jacomini
4,220,954 A 9/1980 Marchand
4,236,158 A 11/1980 Daniel
4,242,685 A 12/1980 Sanford
4,266,203 A 5/1981 Saudreau et al.
4,308,541 A 12/1981 Frosch et al.
4,367,475 A 1/1983 Schiavone
4,370,659 A 1/1983 Chu et al.
4,387,377 A 6/1983 Kandler
4,395,713 A 7/1983 Nelson et al.
4,443,802 A 4/1984 Mayes
4,590,478 A 5/1986 Powers et al.
4,594,595 A 6/1986 Struckman
4,672,386 A 6/1987 Wood
4,684,953 A 8/1987 Hall
4,700,197 A 10/1987 Milne
4,737,795 A 4/1988 Nagy et al.
4,749,996 A 6/1988 Tresselt
4,760,402 A 7/1988 Mizuno et al.
4,782,346 A 11/1988 Sharma
4,803,494 A 2/1989 Norris et al.
4,821,040 A 4/1989 Johnson et al.
4,835,541 A 5/1989 Johnson et al.
4,843,400 A 6/1989 Tsao et al.
4,843,403 A 6/1989 Lazari et al.
4,853,704 A 8/1989 Diaz et al.
4,903,033 A 2/1990 Tsao et al.
4,905,014 A 2/1990 Gonzalez et al.
4,916,457 A 4/1990 Foy et al.
4,922,263 A 5/1990 Dubost et al.
4,958,165 A 9/1990 Axford et al.
4,975,712 A 12/1990 Chen
5,021,795 A 6/1991 Masiulis
5,023,623 A 6/1991 Kreinheder et al.
5,070,340 A 12/1991 Diaz
5,081,466 A 1/1992 Bitter, Jr.
5,115,217 A 5/1992 McGrath et al.
5,146,235 A 9/1992 Frese
5,158,611 A 10/1992 Ura et al.
5,208,603 A 5/1993 Yee
5,218,374 A 6/1993 Koert et al.
5,235,343 A 8/1993 Audren et al.
5,268,696 A 12/1993 Buck et al.
5,268,701 A 12/1993 Smith
5,278,562 A 1/1994 Martin et al.
5,287,116 A 2/1994 Iwasaki et al.
5,287,118 A 2/1994 Budd
5,402,134 A 3/1995 Miller et al.
5,406,292 A 4/1995 Schnetzer et al.
5,519,408 A 5/1996 Schnetzer
5,525,954 A 6/1996 Komazaki et al.
5,531,018 A 7/1996 Saia et al.
5,532,709 A 7/1996 Talty
5,534,877 A 7/1996 Sorbello et al.
5,541,614 A 7/1996 Lam et al.
5,557,291 A 9/1996 Chu et al.
5,581,266 A 12/1996 Peng et al.
5,589,845 A 12/1996 Yandrofski et al.
5,598,172 A 1/1997 Chekroun
5,600,325 A 2/1997 Whelan et al.
5,611,940 A 3/1997 Zettler
5,619,365 A 4/1997 Rhoads et al.
5,619,366 A 4/1997 Rhoads et al.
5,621,571 A 4/1997 Bantli et al.
5,638,946 A 6/1997 Zavracky
5,644,319 A 7/1997 Chen et al.
5,694,134 A 12/1997 Barnes
5,709,245 A 1/1998 Miller
5,721,194 A 2/1998 Yandrofski et al.
5,767,807 A 6/1998 Pritchett
5,808,527 A 9/1998 De Los Santos
5,874,915 A 2/1999 Lee et al.
5,892,485 A 4/1999 Glabe et al.
5,894,288 A 4/1999 Lee et al.
5,905,465 A 5/1999 Olson et al.
5,923,303 A 7/1999 Schwengler et al.
5,926,139 A 7/1999 Korish
5,929,819 A 7/1999 Grinberg
5,943,016 A 8/1999 Snyder, Jr. et al.
5,945,951 A 8/1999 Monte et al.
5,949,382 A 9/1999 Quan
5,966,096 A 10/1999 Brachat
5,966,101 A 10/1999 Haub et al.
6,005,519 A 12/1999 Burns
6,005,521 A 12/1999 Suguro et al.
6,008,770 A 12/1999 Sugawara
6,016,125 A 1/2000 Johansson
6,028,561 A 2/2000 Taker
6,028,692 A 2/2000 Rhoads et al.
6,034,644 A 3/2000 Okabe et al.
6,034,655 A 3/2000 You
6,037,905 A 3/2000 Koscica et al.
6,040,803 A 3/2000 Spall
6,046,655 A 4/2000 Cipolla
6,046,659 A 4/2000 Loo et al.
6,054,659 A 4/2000 Lee et al.
6,055,079 A 4/2000 Hagans et al.
6,061,025 A 5/2000 Jackson et al.
6,075,485 A 6/2000 Lilly et al.
6,081,235 A 6/2000 Romanofsky et al.
6,081,239 A 6/2000 Sabet et al.
6,097,263 A 8/2000 Mueller et al.
6,097,343 A 8/2000 Goetz et al.
6,118,406 A 9/2000 Josypenko
6,118,410 A 9/2000 Nagy
6,127,908 A 10/2000 Bozler et al.
6,150,989 A 11/2000 Aubry
6,154,176 A 11/2000 Fathy et al.
6,166,705 A 12/2000 Mast et al.
6,175,337 B1 1/2001 Jasper, Jr. et al.
6,175,723 B1 1/2001 Rothwell, III
6,188,369 B1 2/2001 Okabe et al.
6,191,724 B1 2/2001 McEwan
6,198,438 B1 3/2001 Herd et al.
6,198,441 B1 3/2001 Okabe et al.
6,204,819 B1 3/2001 Hayes et al.
6,218,912 B1 4/2001 Mayer
6,218,997 B1 4/2001 Lindenmeier et al.
6,246,377 B1 6/2001 Aiello et al.
6,252,473 B1 6/2001 Ando
6,285,325 B1 9/2001 Nalbandian et al.
6,297,579 B1 10/2001 Martin et al.
6,307,519 B1 10/2001 Livingston et al.
6,317,095 B1 11/2001 Teshirogi et al.
6,323,826 B1 11/2001 Sievenpiper et al.
6,331,257 B1 12/2001 Loo et al.
6,337,668 B1 1/2002 Ito et al.
6,366,254 B1 4/2002 Sievenpiper et al.
6,373,349 B2 4/2002 Gilbert
6,380,895 B1 4/2002 Moren et al.
6,388,631 B1 5/2002 Livingston et al.
6,392,610 B1 5/2002 Braun et al.
6,404,390 B2 6/2002 Sheen
6,404,401 B2 6/2002 Gilbert et al.
6,407,719 B1 6/2002 Ohira et al.
6,417,807 B1 7/2002 Hsu et al.
6,424,319 B2 7/2002 Eblin et al.
6,426,722 B1 7/2002 Sievenpiper et al.
6,440,767 B1 8/2002 Loo et al.
6,469,673 B2 10/2002 Kaiponen
6,473,362 B1 10/2002 Gabbay
6,483,480 B1 11/2002 Sievenpiper et al.
6,496,155 B1 12/2002 Sievenpiper et al.
6,515,635 B2 2/2003 Chiang et al.
6,518,931 B1 2/2003 Sievenpiper
6,525,695 B2 2/2003 McKinzie
6,538,621 B1 3/2003 Sievenpiper et al.
6,552,696 B1 4/2003 Sievenpiper et al.
6,624,720 B1 9/2003 Allison
6,642,889 B1 11/2003 McGrath

(56) References Cited

U.S. PATENT DOCUMENTS

| | | | |
|---|---|---|---|
| 6,657,525 | B1 | 12/2003 | Dickens et al. |
| 6,741,207 | B1 | 5/2004 | Allison et al. |
| 6,822,622 | B2 | 11/2004 | Crawford et al. |
| 6,864,848 | B2 | 3/2005 | Sievenpiper |
| 6,897,810 | B2 | 5/2005 | Dai et al. |
| 6,940,363 | B2 | 9/2005 | Zipper |
| 7,068,234 | B2 | 6/2006 | Sievenpiper |
| 7,071,888 | B2 | 7/2006 | Sievenpiper |
| 7,164,387 | B2 | 1/2007 | Sievenpiper |
| 7,173,565 | B2 | 2/2007 | Sievenpiper |
| 7,218,281 | B2 | 5/2007 | Sievenpiper |
| 7,245,269 | B2 | 7/2007 | Sievenpiper et al. |
| 7,253,699 | B2 | 8/2007 | Schaffner |
| 7,253,780 | B2 | 8/2007 | Sievenpiper |
| 7,276,990 | B2 | 10/2007 | Sievenpiper |
| 7,298,228 | B2 | 11/2007 | Sievenpiper |
| 7,307,589 | B1 | 12/2007 | Gregoire et al. |
| 7,782,255 | B2 | 8/2010 | Sego |
| 7,791,251 | B2 | 9/2010 | Kim |
| 7,830,310 | B1 | 11/2010 | Sievenpiper |
| 7,911,386 | B1 | 3/2011 | Itoh et al. |
| 8,212,739 | B2 | 7/2012 | Sievenpiper |
| 8,436,785 | B1 | 5/2013 | Lai |
| 2001/0035801 | A1 | 11/2001 | Gilbert |
| 2002/0036586 | A1 | 3/2002 | Gothard et al. |
| 2003/0034922 | A1 | 2/2003 | Isaacs et al. |
| 2003/0193446 | A1 | 10/2003 | Chen |
| 2003/0222738 | A1 | 12/2003 | Bang et al. |
| 2003/0227351 | A1 | 12/2003 | Sievenpiper |
| 2004/0113713 | A1 | 6/2004 | Zipper et al. |
| 2004/0135649 | A1 | 7/2004 | Sievenpiper |
| 2004/0227583 | A1 | 11/2004 | Shaffner et al. |
| 2004/0227664 | A1 | 11/2004 | Noujeim |
| 2004/0227667 | A1 | 11/2004 | Sievenpiper |
| 2004/0227668 | A1 | 11/2004 | Sievenpiper |
| 2004/0227678 | A1 | 11/2004 | Sievenpiper |
| 2004/0263408 | A1 | 12/2004 | Sievenpiper et al. |
| 2005/0012667 | A1 | 1/2005 | Noujeim |
| 2006/0192465 | A1 | 8/2006 | Kornbluh et al. |
| 2012/0194399 | A1* | 8/2012 | Bily ..... H01Q 13/28 343/772 |
| 2012/0235848 | A1* | 9/2012 | Bruno ..... H01Q 15/0086 342/16 |
| 2013/0021112 | A1* | 1/2013 | Apostolos ..... H01Q 1/52 333/174 |
| 2014/0038662 | A1* | 2/2014 | Alberth, Jr. ..... H01P 1/18 455/550.1 |

FOREIGN PATENT DOCUMENTS

| | | |
|---|---|---|
| EP | 1 158 605 | 11/2001 |
| FR | 2 785 476 | 5/2000 |
| GB | 1145208 | 3/1969 |
| GB | 2 281 662 | 3/1995 |
| GB | 2 328 748 | 3/1999 |
| JP | 61-260702 | 11/1986 |
| WO | 94/00891 | 1/1994 |
| WO | 96/29621 | 9/1996 |
| WO | 98/21734 | 5/1998 |
| WO | 99/50929 | 10/1999 |
| WO | 00/44012 | 7/2000 |
| WO | 01/31737 | 5/2001 |
| WO | 01/73891 | 10/2001 |
| WO | 01/73893 | 10/2001 |
| WO | 03/009501 | 1/2003 |
| WO | 03/098732 | 11/2003 |

OTHER PUBLICATIONS

PCT International Search Report and Written Opinion (ISR and WO) mailed on Apr. 3, 2014 from corresponding PCT Application No. PCT/US2013/050412.

Noujeim, Karam M. Fixed-frequency beam-steerable leaky-wave antennas. Ph. D. Thesis. Department of Electrical and Computer Engineering University of Toronto. National Library of Canada, 1998. (163 pages).

Sazegar, M. et al., Beam Steering Transmitarrav Using Tunable Frequency Selective Surface With Integrated Ferroelectric Varactors, IEEE Transactions on Antennas and Propagation, Aug. 13, 2012. vol. 60, No. 12, pp. 5690-5699, ISSN 0018-926X.

From U.S. Appl. No. 13/242,102, Office Action mailed on Mar. 4, 2014.

From U.S. Appl. No. 13/243,006, Office Action mailed on Dec. 4, 2013.

From U.S. Appl. No. 13/243,006 (unpublished; non-publication request filed), Office Action mailed on Apr. 22, 2014.

From U.S. Appl. No. 13/242,102 (now U.S. Pat. No. 8,994,609) Notice of Allowance mailed on Nov. 24, 2014.

From U.S. Appl. No. 13/242,102 (now published as US 2013-0285871), Office Action mailed on Jul. 18, 2014.

U.S. Appl. No. 13/242,102, filed Sep. 23, 2011, Gregoire.

U.S. Appl. No. 13/243,006, filed Sep. 23, 2011, Gregoire, D., et al.

Bahl, I.J. and Trivedi, D.K., "A designer's guide to microstrip line", *Microwaves*, May 1977, pp. 174-182.

Colburn, J.S., et al. "Adaptive artificial impedance surface conformal antennas," Antennas and Propagation Society International Symposium, 2009. APSURSI '09, IEEE, vol., no., pp. 1-4, Jun. 1-5, 2009.

Fong, B.H.; Colburn, J.S.; Ottusch, J.J.; Visher, J.L.; Sievenpiper, D.F., "Scalar and Tensor Holographic Artificial Impedance Surfaces", *IEEE Trans. Antennas Prop.*, vol. 58, No. 10, pp. 3212-3221, 2010.

Gregoire and J.S. Colburn, *Artificial impedance surface antennas,* Proc. Antennas Appl. Symposium 2011, pp. 460-475.

Gregoire, D. and Colburn, J. S., "Artificial impedance surface antenna design and simulation", 2010 Proceedings of the 2010 Antenna Applications Symposium, pp. 288-303.

Klopfenstein, R.W., "A transmission line of improved design", *Proceedings of the IRE*, pp. 31-35, Jan. 1956.

Luukkonen et al, "Simple and accurate analytical model of planar grids and high-impedance surfaces comprosing metal strips or patches", IEEE Trans. Antennas Prop., vol. 56, 1624, 2008.

Ottusch, J.J.; Kabakian, A.; Visher, J.L.; Fong, B.H.; Colburn, J.S.; and Sievenpiper, D.F.; "Tensor Impedance Surfaces", AFOSR Electromagnetics Meeting, Jan. 6, 2009.

Patel, A.M.; Grbic, A., "A Printed Leaky-Wave Antenna Based on a Sinusoidally-Modulated Reactance Surface," Antennas and Propagation, IEEE Transactions on , vol. 59, No. 6, pp. 2087, 2096, Jun. 2011.

Sievenpiper, D. et al, "Holographic Artificial Impedance Surfaces for conformal antennas", 29th Antennas Applications Symposium, 2005.

Sievenpiper, D., et al. "A steerable leaky-wave antenna using a tunable impedance ground plane," Antennas and Wireless Propagation Letters, IEEE, vol. I, No. I, pp. 179-182, 2002.

Sievenpiper, D., et al., 2005 "Holographic Artificial Impedance Surfaces for Conformal Antennas" IEEE Antennas and Prop. Symp. Digest, vol. 1B, pp. 256-259, 2005.

Simovskii et al, "High-impedance surfaces having stable resonance with respect to polarization and incidence angel", *IEEE Trans, Antennas Prop.,* vol. 53, 908, 2005.

Notice of Allowance dated Nov. 5, 2014 for U.S. Appl. No. 13/243,006 (unpublished/non publication request filed Sep. 23, 2011).

From U.S. Appl. No. 11/324,064 (now U.S. Pat. No. 7,307,589), Application and Office Actions including but not limited to the office actions mailed on Apr. 18, 2007 and Aug. 23, 2007.

From U.S. Appl. No. 12/939,040 (now U.S. Pat. No. 8,436,785), Application and Office Actions including but not limited to the office action mailed on Jan. 10, 2013.

From U.S. Appl. No. 13/242,102, Application and Office Actions including but not limited to the office action mailed on Sep. 27, 2013.

From U.S. Appl. No. 13/243,006, Application and Office Actions.

Balanis, C., "Aperture Antennas," Antenna Theory, Analysis and Design, 2nd Edition, Ch. 12, pp. 575-597 (1997).

(56) References Cited

OTHER PUBLICATIONS

Balanis, C., "Microstrip Antennas," Antenna Theory, Analysis and Design, 2nd Edition, Ch. 14, pp. 722-736 (1997).
Bialkowski, M.E., et al., "Electronically Steered Antenna System for the Australian Mobilesat," IEEE Proc.-Microw. Antennas Propag., vol. 143, No. 4, pp. 347-352 (Aug. 1996).
Bradley, T.W., et al., "Development of a Voltage-Variable Dielectric (VVD), Electronic Scan Antenna," Radar 97, Publication No. 449, pp. 383-385 (Oct. 1997).
Brown, W.C., "The History of Power Transmission by Radio Waves," IEEE Transactions on Microwave Theory and Techniques, vol. MTT-32, No. 9, pp. 1230-1242 (Sep. 1984).
Bushbeck, M.D., et al., "A tunable switcher dielectric grating", IEEE Microwave and Guided Wave letters, vol. 3, No. 9, pp. 296-298 (Sep. 1993).
Chambers, B., et al., "Tunable Radar Absorbers Using Frequency Selective Surfaces," 11th International Conference on Antennas and Propagation, Conference Publication No. 480, pp. 593-598 (Apr. 17 20, 2001).
Chang, T.K., et al., "Frequency Selective Surfaces on Biased Ferrite Substrates", Electronics Letters, vol. 3o, No. 15, pp. 1193-1194 (Jul. 21, 1994).
Chen, P.W., et al., "Planar Double-Layer Leaky-Wave Microstrip Antenna," IEEE Transactions on Antennas and Propagation, vol. 50, pp. 832-835 (2002).
Chen, Q., et al., "FDTD diakoptic design of a slot-loop antenna excited by a coplanar waveguide," Proceedings of the 25th European Microwave Conference 1995, vol. 2, Conf. 25, pp. 815-819 (Sep. 4, 1995).
Cognard, J., "Alignment of Nematic Liquid Crystals and Their Mixtures," Mol. Cryst. Liq., Cryst. Suppl. 1, pp. 1-74 (1982).
Doane, J.W., et al., "Field Controlled Light Scattering from Nematic Microdroplets," Appl. Phys. Lett., vol. 48, pp. 269-271 (Jan. 1986).
Ellis, T.J. et al., "MM-Wave Tapered Slot Antennas on Micromachined Photonic Bandgap Dielectrics," 1996 IEEE MTT-S International Microwave Symposium Digest, vol. 2, pp. 1157-1160 (1996).
Fay, P., "High-Performance Antimonide-Based Heterostructure Backward Diodes for Millimeter-Wave Detection," IEEE Electron Device Letters, vol. 23, No. 10, pp. 585-587 (Oct. 2002).
Gianvittorio, J.P., et al., "Reconfigurable MEMS-enabled Frequency Selective surfaces", Electronic Letters, vol. 38, No. 25, pp. 16527-1628 (Dec. 5, 2002).
Gold, S.H., et al., "Review of High-Power Microwave Source Research," Rev. Sci. Instrum., vol. 68, No.11, pp. 3945-3974 (Nov. 1997).
Grbic, A., et al., "Experimental Verification of Backward-Wave Radiation From a Negative Refractive Index Metamaterial," Journal of Applied Physics, vol. 92, No. 10, pp. 5930-5935 (Nov. 15, 2002).
Hu, C.N., et al., "Analysis and Design of Large Leaky-Mode Array Employing The Coupled-Mode Approach," IEEE Transactions on Microwave Theory and Techniques, vol. 49, No. 4, pp. 629-636 (Apr. 2001).
Jablonski, W., et al., "Microwave Schottky Diode With Beam-Lead Contacts," 13th Conference on Microwaves, Radar and Wireless Communications, MIKON-2000, vol. 2, pp. 678-681 (2000).
Jensen, M.A., et al., "EM Interaction of Handset Antennas and a Human in Personal Communications," Proceedings of the IEEE, vol. 83, No. 1, pp. 7-17 (Jan. 1995).
Jensen, M.A., et al., "Performance Analysis of Antennas for Hand-Held Transceivers Using FDTD," IEEE Transactions on Antennas and Propagation, vol. 42, No. 8, pp. 1106-1113 (Aug. 1994).
Koert, P., et al., "Millimeter Wave Technology for Space Power Beaming," IEEE Transactions on Microwave Theory and Techniques, vol. 40, No. 6, pp. 1251-1258 (Jun. 1992).
Lee, J.W., et al., "TM-Wave Reduction from Grooves in a Dielectric-Covered Ground Plane," IEEE Transactions on Antennas and Propagation, vol. 49, No. 1, pp. 104-105 (Jan. 2001).
Lezec, H.J., et al., "Beaming Light from a Subwavelength Aperture," Science, vol. 297, pp. 820-822.(Aug. 2, 2002).
Lima, A.C., et al., "Tunable Freuency Selective Surfaces Using Liquid Substrates", Electronic Letters, vol. 30, No. 4, pp. 281-282 (Feb. 17, 1994).
Linardou, I., et al., "Twin Vivaldi Antenna Fed by Coplanar Waveguide," Electronics Letters, vol. 33, No. 22, pp. 1835-1837 (1997).
Malherbe, A., et al., "The Compensation of Step Discontinues in TEM-Mode Transmission Lines," IEEE Transactions on Microwave Theory and Techniques, vol. MTT-26, No. 11, pp. 883-885 (Nov. 1978).
Maruhashi, K., et al., "Design and Performance of a Ka-Band Monolithic Phase Shifter Utilizing Nonresonant FET Switches," IEEE Transactions on Microwave Theory and Techniques, vol. 48, No. 8, pp. 1313-1317 (Aug. 2000).
McSpadden, J.O., et al., "Design and Experiments of a High-Conversion-Efficiency 5.8-GHz Rectenna," IEEE Transactions on Microwave Theory and Techniques, vol. 46, No. 12, pp. 2053-2060 (Dec. 1998).
Oak, A.C., et al., "A Varactor Tuned 16 Element MESFET grid Oscillator", Antennas an Propagation Society International Symposium, pp. 1296-1299 (1995).
Perini, P., et al., "Angle and Space Diversity Comparisons in Different Mobile Radio Environments," IEEE Transactions on Antennas and Propagation, vol. 46, No. 6, pp. 764-775 (Jun. 1998).
Ramo, S., et al., Fields and Waves in Communication Electronics, 3rd Edition, Sections 9.8-9.11, pp. 476-487 (1994).
Rebeiz, G.M., et al., "RF MEMS Switches and Switch Circuits," IEEE Microwave Magazine, pp. 59-71 (Dec. 2001).
Schaffner, J., et al., "Reconfigurable Aperture Antennas Using RF MEMS Switches for Multi-Octave Tunability and Beam Steering," IEEE Antennas and Propagation Society International Symposium, 2000 Digest, vol. 1 of 4, pp. 321-324 (Jul. 16, 2000.
Schulman, J.N., et al., "Sb-Heterostructure Interband Backward Diodes," IEEE Electron Device Letters, vol. 21, No. 7, pp. 353-355 (Jul. 2000).
Semouchkina, E., et al., "Numerical Modeling and Experimental Study of a Novel Leaky Wave Antenna," Antennas and Propagation Society, IEEE International Symposium, vol. 4, pp. 234-237 (2001).
Sieveniper, D.F., et al., "Two-Dimensional Beam Steering Using an Electrically Tunable Impedance Surface," IEEE Transactions on Antennas and Propagation, vol. 51, No. 10, pp. 2713-2722 (Oct. 2003).
Sievenpiper, D., et al., "Beam Steering Microwave Reflector Based on Electrically Tunable Impedance Surface," Electronics Letters, vol. 38, No. 21, pp. 1237-1238 (Oct. 1, 2002).
Sievenpiper, D., et al., "Eliminating Surface Currents With Metallodielectric Photonic Crystals," 1998 MTT-S International Microwave Symposium Digest, vol. 2, pp. 663-666 (Jun. 7, 1998).
Sievenpiper, D., et al., "High-Impedance Electromagnetic Surfaces with a Forbidden Frequency Band," IEEE Transactions, on Microwave Theory and Techniques, vol. 47, No. 11, pp. 2059-2074 (Nov. 1999).
Sievenpiper, D., et al., "High-Impedance Electromagnetic Surfaces," Ph.D. Dissertation, Dept. of Electrical Engineering, University of California, Los Angeles, CA, pp. i-xi, 1-150 (1999).
Sievenpiper, D., et al., "Low-Profile, Four-Sector Diversity Antenna on High-Impedance Ground Plane," Electronics Letters, vol. 36, No. 16, pp. 1343-1345 (Aug. 3, 2000).
Sor, J., et al., "A Reconfigurable Leaky-Wave/Patch Microstrip Aperture for Phased-Array Applications," IEEE Transactions on Microwave Theory and Techniques, vol. 50, No. 8, pp. 1877-1884 (Aug. 2002).
Strasser, B., et al., "5.8-GHz Circularly Polarized Rectifying Antenna for Wireless Microwave Power Transmission," IEEE Transactions on Microwave Theory and Techniques, vol. 50, No. 8, pp. 1870-1876 (Aug. 2002).
Swartz, N., "Ready for CDMA 2000 1xEV-Do?," Wireless Review, 2 pages total (Oct. 29, 2001).
Vaughan, Mark J., et al., "InP-Based 28 Gh.sub.2 Integrated Antennas for Point-to-Multipoint Distribution," Proceedings of the IEEE/Cornell Conference on Advanced Concepts in High Speed Semiconductor Devices and Circuits, pp. 75-84 (1995).

(56) References Cited

OTHER PUBLICATIONS

Vaughan, R., "Spaced Directive Antennas for Mobile Communications by the Fourier Transform Method," IEEE Transactions on Antennas and Propagation, vol. 48, No. 7, pp. 1025-1032 (Jul. 2000).

Wang, C.J., et al., "Two-Dimensional Scanning Leaky-Wave Antenna by Utilizing the Phased Array," IEEE Microwave and Wireless Components Letters, vol. 12, No. 8, pp. 311-313, (Aug. 2002).

Wu, S.T., et al., "High Birefringence and Wide Nematic Range Bis-Tolane Liquid Crystals," Appl. Phys. Lett., vol. 74, No. 5, pp. 344-346 (Jan. 18, 1999).

Yang, F.R., et al., "A Uniplanar Compact Photonic-Bandgap (UC-PBG) Structure and Its Applications for Microwave Circuits," IEEE Transactions on Microwave Theory and Techniques, vol. 47, No. 8, pp. 1509-1514 (Aug. 1999).

Yang, Hung-Yu David, et al., "Theory of Line-Source Radiation From a Metal-Strip Grating Dielectric-Slab Structure," IEEE Transactions on Antennas and Propagation, vol. 48, No. 4, pp. 556-564 (2000).

Yashchyshyn, Y., et al., The Leaky-Wave Antenna With Ferroelectric Substrate, 14th International Conference on Microwaves, Radar and Wireless Communications, MIKON-2002, vol. 2, pp. 218-221 (2002).

* cited by examiner

LOW COST, 2D, ELECTRONICALLY-STEERABLE, ARTIFICIAL-IMPEDANCE-SURFACE ANTENNA

CROSS REFERENCE TO RELATED APPLICATIONS

This application is related to the disclosure of U.S. patent application Ser. No. 12/939,040 filed Nov. 3, 2010, and U.S. patent application Ser. No. 13/242,102 filed Sep. 23, 2011, the disclosures of which are hereby incorporated herein by reference.

TECHNICAL FIELD

This disclosure relates to artificial impedance surface antennas (AISAs).

BACKGROUND

An antenna whose primary gain lobe can be electronically steered in two dimensions is desirable in many applications. In the prior art the two dimensional steering is most commonly provided by phased array antennas. Phased array antennas have complex electronics and are quite costly.

In the prior art, various electronically steered artificial impedance surface antennas (AISAs) have been described that have one dimensional electronic steering, including the AISAs described in U.S. Pat. Nos. 7,245,269, 7,071,888, and U.S. Pat. No. 7,253,780 to Sievenpiper. These antennas are useful for some applications, but are not suitable for all applications that need two dimensional steering. In some applications mechanical steering can be used to provide steering of a 1D electronically steered antenna in a second dimension. However, there are many applications where mechanical steering is very undesirable. The antennas described by Sievenpiper also require vias for providing voltage control to varactors.

A two dimensionally electronically steered AISA has been described in U.S. Pat. No. 8,436,785, issued on May 7, 2013, to Lai and Colburn. The antenna described by Lai and Colburn is relatively costly and is electronically complex, because to steer in two dimensions a complex network of voltage control to a two dimensional array of impedance elements is required so that an arbitrary impedance pattern can be created to produce beam steering in any direction.

Artificial impedance surface antennas (AISAS) are realized by launching a surface wave across an artificial impedance surface (AIS), whose impedance is spatially modulated across the AIS according a function that matches the phase fronts between the surface wave on the AIS and the desired far-field radiation pattern.

In previous references, listed below, references [1]-[6] describe artificial impedance surface antennas (AISA) formed from modulated artificial impedance surfaces (AIS). Patel [1] demonstrated a scalar AISA using an end-fire, flare-fed one-dimensional, spatially-modulated AIS consisting of a linear array of metallic strips on a grounded dielectric. Sievenpiper, Colburn and Fong [2]-[4] have demonstrated scalar and tensor AISAs on both flat and curved surfaces using waveguide- or dipole-fed, two-dimensional, spatially-modulated AIS consisting of a grounded dielectric topped with a grid of metallic patches. Gregoire [5]-[6] has examined the dependence of AISA operation on its design properties.

Referring to FIG. 1, the basic principle of AISA operation is to use the grid momentum of the modulated AIS to match the wave vectors of an excited surface-wave front to a desired plane wave. In the one-dimensional case, this can be expressed as $$k_{sw}=k_o \sin \theta_o - k_p \tag{1}$$

where $k_o$ is the radiation's free-space wavenumber at the design frequency, $\theta_o$ is the angle of the desired radiation with respect to the AIS normal, $k_p=2\pi/p$ is the AIS grid momentum where p is the AIS modulation period, and $k_{sw}=n_o k_o$ is the surface wave's wavenumber, where $n_o$ is the surface wave's refractive index averaged over the AIS modulation. The SW impedance is typically chosen to have a pattern that modulates the SW impedance sinusoidally along the SWG according to $$Z(x)=X+M \cos(2\pi x/p) \tag{2}$$

where p is the period of the modulation, X is the mean impedance, and M is the modulation amplitude. X, M and p are chosen such that the angle of the radiation θ in the x-z plane w.r.t the z axis is determined by $$\theta=\sin^{-1}(n_0-\lambda_0/p) \tag{3}$$

where $n_0$ is the mean SW index, and $\lambda_0$ is the free-space wavelength of radiation. $n_0$ is related to Z(x) by $$n_0 = \frac{1}{p}\int_0^p \sqrt{1+Z(x)^2}\, dx \approx \sqrt{1+X^2} \tag{4}$$

The AISA impedance modulation of Eqn. (2) can be generalized for an AISA of any shape as $$Z(\vec{r})=X+M \cos(k_o n_o r-\vec{k}_o \square \vec{r}) \tag{5}$$

where $\vec{k}_o$ is the desired radiation wave vector, $\vec{r}$ is the three-dimensional position vector of the AIS, and r is the distance along the AIS from the surface-wave source to $\vec{r}$ along a geodesic on the AIS surface. This expression can be used to determine the index modulation for an AISA of any geometry, flat, cylindrical, spherical, or any arbitrary shape. In some cases, determining the value of r is geometrically complex.

For a flat AISA, it is simply $r=\sqrt{x^2+y^2}$.

For a flat AISA designed to radiate into the wave vector at $\vec{k}=k_o(\sin \theta_o \hat{x}+\cos \theta_o \hat{z})$, with the surface-wave source located at x=y=0, the modulation function is $$Z(x,y)=X+M \cos(k_o(n_o r-x \sin \theta_o)) \tag{6}$$

The cos function in Eqn. (2) can be replaced with any periodic function and the AISA will still operate as designed, but the details of the side lobes, bandwidth and beam squint will be affected.

The AIS can be realized as a grid of metallic patches on a grounded dielectric. The desired index modulation is produced by varying the size of the patches according to a function that correlates the patch size to the surface wave index. The correlation between index and patch size can be determined using simulations, calculation and/or measurement techniques. For example, Colburn [3] and Fong [4] use a combination of HFSS unit-cell eigenvalue simulations and near field measurements of test boards to determine their correlation function. Fast approximate methods presented by Luukkonen [7] can also be used to calculate the correlation. However, empirical correction factors are often applied to these methods. In many regimes, these methods agree very well with HFSS eigenvalue simulations and near-field measurements. They break down when the patch size is large compared to the substrate thickness, or when the surface-wave phase shift per unit cell approaches 180°.

In the prior art electronically-steerable AIS antennas described in [8] and [9], the AIS is a grid of metallic patches on a dielectric substrate. The surface-wave impedance is locally controlled at each position on the AIS by applying a variable voltage to voltage-variable varactors connected between each of the patches. It is well known that an AIS's SW impedance can be tuned with capacitive loads inserted between impedance elements [8], [9]. Each patch is electrically connected to neighboring patches on all four sides with voltage-variable varactor capacitor. The voltage is applied to the varactors though electrical vias connected to each impedance element patch. Half of the patches are electrically connected to the groundplane with vias that run from the center of each patch down through the dielectric substrate. The rest of the patches are electrically connected to voltage sources that run through the substrates, and through holes in the ground plane to the voltage sources.

Computer control allows any desired impedance pattern to be applied to the AIS within the limits of the varactor tunability and the AIS SW property limitations. One of the limitations of this method is that the vias can severely reduce the operation bandwidth of the AIS because the vias also impart an inductance to the AIS that shifts the SW bandgap to lower frequency. As the varactors are tuned to higher capacitance, the AIS inductance is increased and this further reduces the SW bandgap frequency. The net result of the SW bandgap is that it does not allow the AIS to be used above the bandgap frequency. It also limits the range of SW impedance that the AIS can be tuned to.

REFERENCES

1. Patel, A. M.; Grbic, A., "A Printed Leaky-Wave Antenna Based on a Sinusoidally-Modulated Reactance Surface," Antennas and Propagation, IEEE Transactions on, vol. 59, no. 6, pp. 2087, 2096, June 2011
2. D. Sievenpiper et al, "Holographic AISs for conformal antennas", 29th Antennas Applications Symposium, 2005
3. D. Sievenpiper, J. Colburn, B. Fong, J. Ottusch and J. Visher., 2005 IEEE Antennas and Prop. Symp. Digest, vol. 1B, pp. 256-259, 2005.
4. B. Fong et al, "Scalar and Tensor Holographic Artificial Impedance Surfaces," IEEE TAP., 58, 2010
5. D. J. Gregoire and J. S. Colburn, *Artificial impedance surface antennas*, Proc. Antennas Appl. Symposium 2011, pp. 460-475
6. D. J. Gregoire and J. S. Colburn, *Artificial impedance surface antenna design and simulation*, Proc. Antennas Appl. Symposium 2010, pp. 288-303
7. O. Luukkonen et al, "Simple and accurate analytical model of planar grids and high-impedance surfaces comprising metal strips or patches", IEEE Trans. Antennas Prop., vol. 56, 1624, 2008
8. Colburn, J. S.; Lai, A.; Sievenpiper, D. F.; Bekaryan, A.; Fong, B. H.; Ottusch, J. J.; Tulythan, P.; "Adaptive artificial impedance surface conformal antennas," Antennas and Propagation Society International Symposium, 2009. APSURSI '09. IEEE, vol., no., pp. 1-4, 1-5 Jun. 2009
9. Sievenpiper, D.; Schaffner, J.; Lee, J. J.; Livingston, S.; "A steerable leaky-wave antenna using a tunable impedance ground plane," Antennas and Wireless Propagation Letters, IEEE, vol. 1, no. 1, pp. 179-182, 2002.

What is needed is an electronically steered artificial impedance surface antenna (AISA) that can be steered in two dimensions, while being lower cost. The embodiments of the present disclosure answer these and other needs.

SUMMARY

In a first embodiment disclosed herein, a steerable artificial impedance surface antenna steerable in phi and theta angles comprises dielectric substrate, a plurality of metallic strips on a first surface of the dielectric substrate, the metallic strips spaced apart across a length of the dielectric substrate and each metallic strip extending along a width of the dielectric substrate, and surface wave feeds spaced apart along the width of the dielectric substrate near an edge of the dielectric substrate, wherein the dielectric substrate is substantially in an X-Y plane defined by an X axis and a Y axis, wherein the phi angle is an angle in the X-Y plane relative to the X axis, and wherein the theta angle is an angle relative to a Z axis orthogonal to the X-Y plane.

In another embodiment disclosed herein, a steerable artificial impedance surface antenna steerable in phi and theta angles comprises a dielectric substrate, a plurality of metallic strips on a first surface of the dielectric substrate, the metallic strips spaced apart across a length of the dielectric substrate, the metallic strips having equally spaced centers, the metallic strips varying in width with a period of p, and each metallic strip extending along a width of the dielectric substrate, and surface wave feeds spaced apart along a width of the dielectric substrate near an edge of the dielectric substrate, wherein the dielectric substrate is substantially in an X-Y plane defined by an X axis and a Y axis, wherein the phi angle is an angle in the X-Y plane relative to the X axis, and wherein the theta angle is an angle relative to a Z axis orthogonal to the X-Y plane.

These and other features and advantages will become further apparent from the detailed description and accompanying figures that follow. In the figures and description, numerals indicate the various features, like numerals referring to like features throughout both the drawings and the description.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 2A:
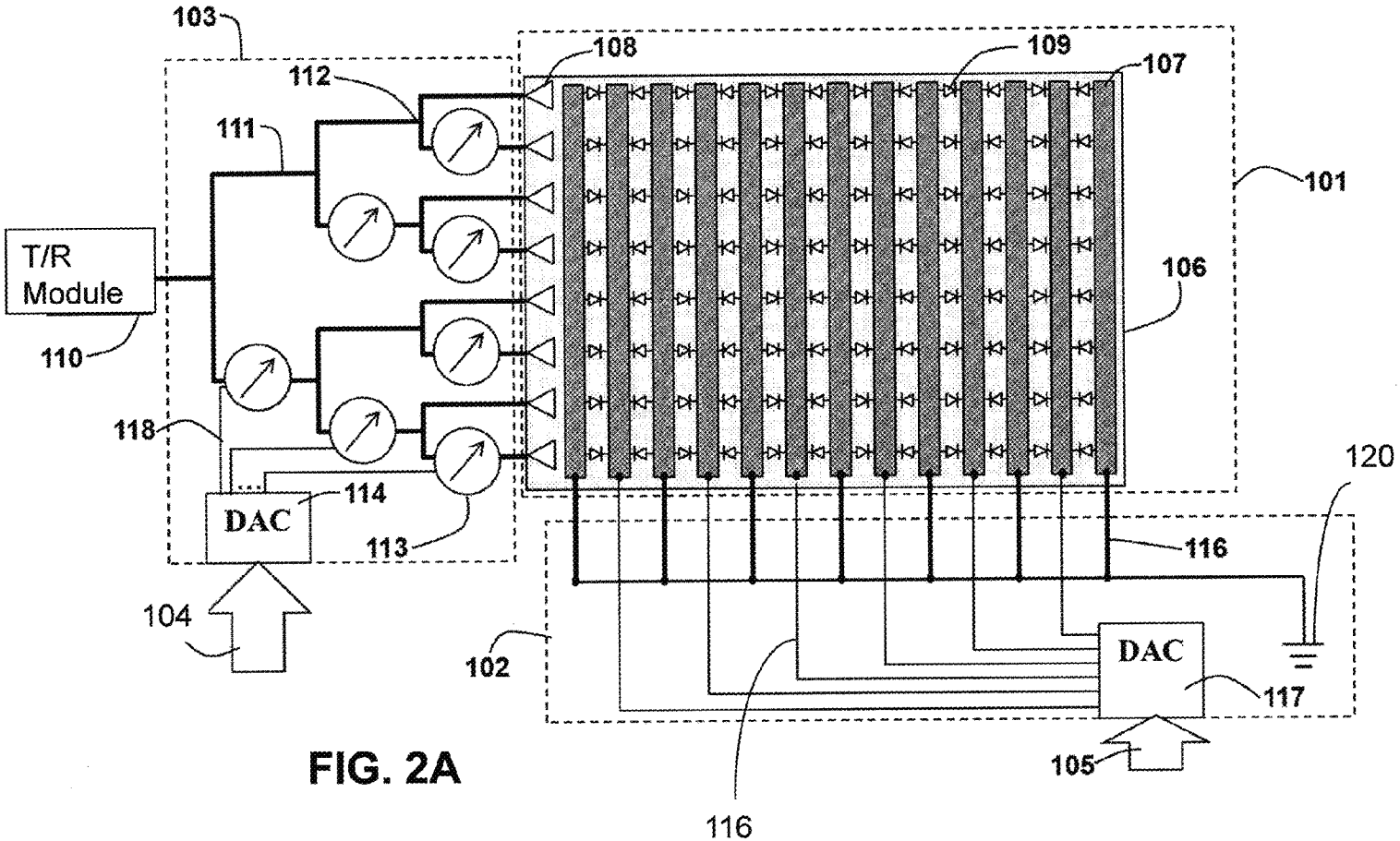
FIG. 2A shows an electronically steered artificial impedance surface antenna (AISA)
Figure 3:
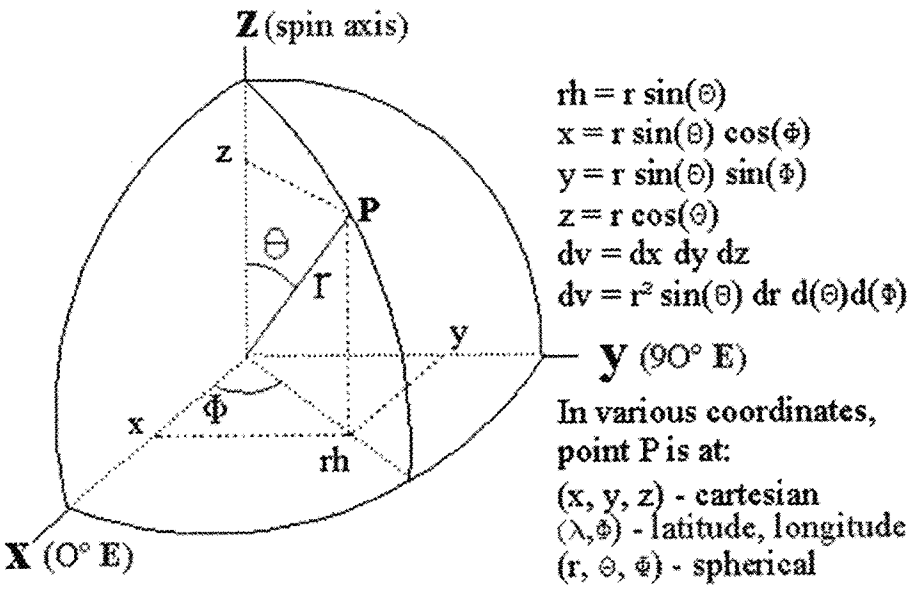
FIG. 3 PRIOR ART
FIG. 3 is a diagram of a spherical coordinate system showing the angles and the transformations to Cartesian coordinates in accordance with the prior art.

FIG. 2A shows an electronically steered artificial impedance surface antenna (AISA) in accordance with the present disclosure that is relatively low cost and capable of steering in both theta (θ) and phi (ϕ) directions. FIG. 3 is a diagram of a spherical coordinate system showing the theta (θ) and phi (ϕ) angles. In FIG. 3 the phi (ϕ) angle is the angle in the x-y plane, and the theta (θ) angle is the angle from the z axis. Because the primary gain lobe of the electronically steered artificial impedance surface antenna (AISA) in accordance with the present disclosure is capable of steering in both theta (θ) and phi (ϕ) directions, those skilled in the art refer to it as a 2D electronically steered artificial impedance surface antenna (AISA).

The electronically steered artificial impedance surface antenna (AISA) of FIG. 2A includes a tunable artificial impedance surface antenna (AISA) 101, a voltage control network 102, and a one-dimensional 1D radio frequency (RF) feed network 103. When the tunable artificial impedance surface antenna (AISA) 101 is in the X-Y plane of FIG. 3, the steering of the primary gain lobe of the electronically steered artificial impedance surface antenna (AISA) is controlled in the phi (ϕ) direction by changing the relative phase difference between the RF surface wave feeds 108 of the 1D RF feed network 103. The theta steering is controlled by varying or modulating the surface wave impedance of the tunable artificial impedance surface antenna (AISA) 101.

The artificial impedance surface antenna (AISA) 101 in the embodiment of FIG. 2A includes a dielectric substrate 106, a periodic array of metallic strips 107 on one surface of the dielectric substrate 106, varactors 109 electrically connected between the metallic strips 107, and a 1D array of RF surface wave feeds 108. The impedance of the AISA 101 may be varied or modulated by controlling voltages to the metallic strips 107 on the tunable artificial impedance surface antenna (AISA) 101. The voltages on the metallic strips 107 change the capacitance of varactors 109 between the metallic strips 107, which changes the impedance of the AISA 101, thereby steering the primary gain lobe in the theta direction.

The voltage control network 102 applies direct current (DC) voltages to the metallic strips 107 on the AISA structure. Control bus 105 provides control for the voltage control network 102. The control bus 105 may be from a microprocessor, central processing unit, or any computer or processor.

Control bus 104 provides control for the 1D RF feed network 103. The control bus 104 may be from a microprocessor, central processing unit, or any computer or processor.

Figure 2B:
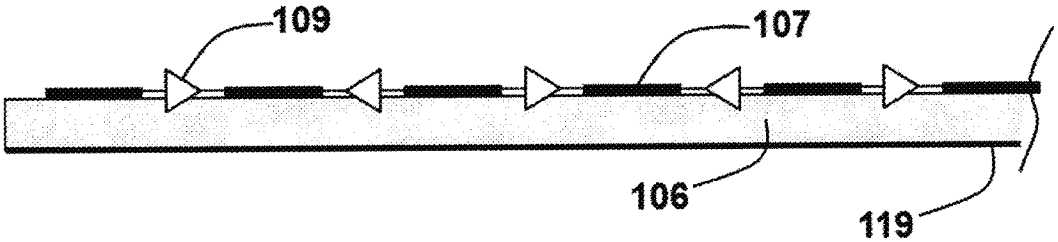
FIG. 2B shows a side elevation view of an AISA in accordance with the present disclosure.

FIG. 2B shows a side elevation view of FIG. 2A. As shown varactors 109 are between the metallic strips 107, which are on the surface of the dielectric substrate 106. The dielectric substrate 106 may or may not have a ground plane 119 on a surface opposite to the surface upon which the metallic strips 107 are located. As further described below, in one embodiment shown in FIG. 6, varactors are not between the metallic strips 107. In another embodiment, shown in FIG. 7, and further described below, varactors are again not used; however, the dielectric substrate 106 may further include a material 404 with tunable electrical properties, such as a liquid crystal. When a voltage is applied to the impedance elements, such as the metallic strips 107, which may be formed, deposited, printed, or pasted onto the dielectric substrate 106, the properties of the dielectric substrate 106, or the material 404 with tunable electrical properties may change. In particular the dielectric constant may change, thereby changing the impedance between the metallic strips 107, and thereby steering a beam in the theta direction.

A varactor is a type of diode whose capacitance varies as a function of the voltage applied across its terminals, which makes it useful for tuning applications. When varactors 109 are used between the metallic strips 107, as shown in FIG. 2A, by controlling the voltage applied to the varactors 109 via the metallic strips 107, the capacitances of the varactors 109 vary, which in turn varies or modulates the capacitive coupling and the impedance between the metallic strips 107 to steer a beam in the theta direction.

The polarities of the varactors 109 are aligned such that all the varactor connections to any one of the metallic strips 107 are connected with the same polarity. One terminal on a varactor may be referred to as an anode, and the other terminal as a cathode. Thus, some of the metallic strips 107 are only connected to anodes of varactors 109, and other metallic strips 107 are only connected to cathodes of varactors 109. Further, as shown in FIG. 2A, adjacent metallic strips 107 on the AISA 101 alternate in being connected to anodes or cathodes of varactors 109.

The spacing of the metallic strips 107 in one dimension of the AISA, which may, for example, be the X axis of FIG. 3, may be a fraction of the RF surface wave (SW) wavelength of the RF waves that propagate across the AISA from the RF surface wave feeds 108. In a preferred embodiment, the spacing of the metallic strips 107 may be at most ⅕ of the RF surface wave (SW) wavelength of the RF waves. Typically the fraction may be only about 1/10 of the RF surface wave (SW) wavelength of the RF waves.

The spacing between varactors 109 connected to the metallic strips 107 in a second dimension of the AISA, which is generally orthogonal to the first dimension of the AISA and which may be the Y axis of FIG. 3, is typically about the same as the spacing between metallic strips.

The RF SW feeds 108 may be a phased array corporate feed structure, or may be conformal surface wave feeds, which are integrated into the AISA, such as by using micro-strips. Conformal surface wave feeds that may be used include those described in U.S. patent application Ser. No. 13/242,102 filed Sep. 23, 2011, or those described in "Directional Coupler for Transverse-Electric Surface Waves", published in IP.com Prior Art Database Disclosure No. IPCOM000183639D, May 29, 2009, which are incorporated herein by reference as though set forth in full.

The spacing between the RF SW feeds 108 in the second dimension of the AISA or the y dimension of FIG. 3, may be based on rules of thumb for phased array antennas that dictate they be no farther apart than ½ of the free-space wavelength for the highest frequency signal to be transmitted or received.

The thickness of the dielectric substrate 106 is determined by its permittivity and the frequency of radiation to be transmitted or received. The higher the permittivity, the thinner the substrate can be.

The capacitance values of the varactors 109 are determined by the range necessary for the desired AISA impedance modulations to obtain the various angles of radiation.

An AISA operating at about 10 GHz may use for the dielectric substrate 106, a 50-mil thick Rogers Corp 3010 circuit board material with a relative permittivity equal to 11.2. The metallic strips 107 may be spaced 2 millimeters (mm) to 3 mm apart on the dielectric substrate 106. The RF surface wave feeds 108 may be spaced 1.5 centimeters (cm) apart and the varactors 109 may be spaced 2 mm to 3 mm apart. The varactors 109 vary in capacitance from 0.2 to 2.0 pico farads (pF). Designs for different radiation frequencies or designs using different substrates will vary accordingly.

To transmit or receive an RF signal, transmit/receive module 110 is connected to the feed network 103. The feed network 103 can be of any type that is known to those skilled in the state of the art of phased array antennas. For the sake of illustration, the feed network 103 shown in FIG. 2A includes a series of RF transmission lines 111 connected to the transmit/receive module 110, power dividers 112, and phase shifters 113. The phase shifters 113 are controlled by voltage control lines 118 from a digital to analog converter (DAC) 114 that receives digital control signals 104 to control the steering in the phi (ϕ) direction.

The antenna main lobe is steered in the phi direction by using the feed network 103 to impose a phase shift between each of the RF SW feeds 108. If the RF SW feeds 108 are spaced uniformly, then the phase shift between adjacent RF SW feeds 108 is constant. The relation between the phi (ϕ) steering angle, and the phase shift may be calculated using standard phased array methods, according to equation, $$\phi=\sin^{-1}(\lambda\Delta\psi/2\pi d) \tag{7}$$

where λ is the radiation wavelength, d is the spacing between SW feeds 108, and Δψ is the phase shift between SW feeds 108. The RF SW feeds 108 may also be spaced non-uniformly, and the phase shifts adjusted accordingly.

The antenna lobe is steered in the theta (θ) direction by applying voltages to the varactors 109 between the metallic strips 107 such that AISA 101 has surface-wave impedance $Z_{sw}$, that is modulated or varied periodically with the distance (x) away from the SW feeds 108, according to equation, $$Z_{sw}=X+M\cos(2\pi x/p) \tag{8}$$

where X and M are the mean impedance and the amplitude of its modulation respectively, and p is the modulation period. The variation of the surface-wave impedance $Z_{sw}$ may be modulated sinusoidally. The theta steering angle θ, is related to the impedance modulation by the equation, $$\theta=\sin^{-1}(n_{sw}-\lambda/p) \tag{9}$$

where λ is the wavelength of the radiation, and $$n_{sw}=\sqrt{(X/377)^2+1} \tag{10}$$

is the mean surface-wave index.

The beam is steered in the theta direction by tuning the varactor voltages such that X, M, and p result in the desired theta θ. The dependence of the surface wave (SW) impedance on the varactor capacitance is calculated using transcendental equations resulting from the transverse resonance method or by using full-wave numerical simulations.

In the embodiment of FIG. 2A, voltages are applied to the varactors 109 by grounding alternate metallic strips 107 to ground 120 and applying tunable voltages via voltage control lines 116 to the rest of the strips 107. The voltage applied to each voltage control line 116 is a function of the desired theta (θ), and may be different for each voltage control line 116. The voltages may be applied from a digital-to-analog converter (DAC) 117 that receives digital controls 105 from a controller for steering in the theta direction. The controller may be a microprocessor, central processing unit (CPU) or any computer, processor or controller.

An advantage of grounding half of the metallic strips 107 is that only half as many voltage control lines 116 are required as there are metallic strips 107. A disadvantage is that the spatial resolution of the voltage control and hence the impedance modulation is limited to twice the spacing between metallic strips.

Figure 4:
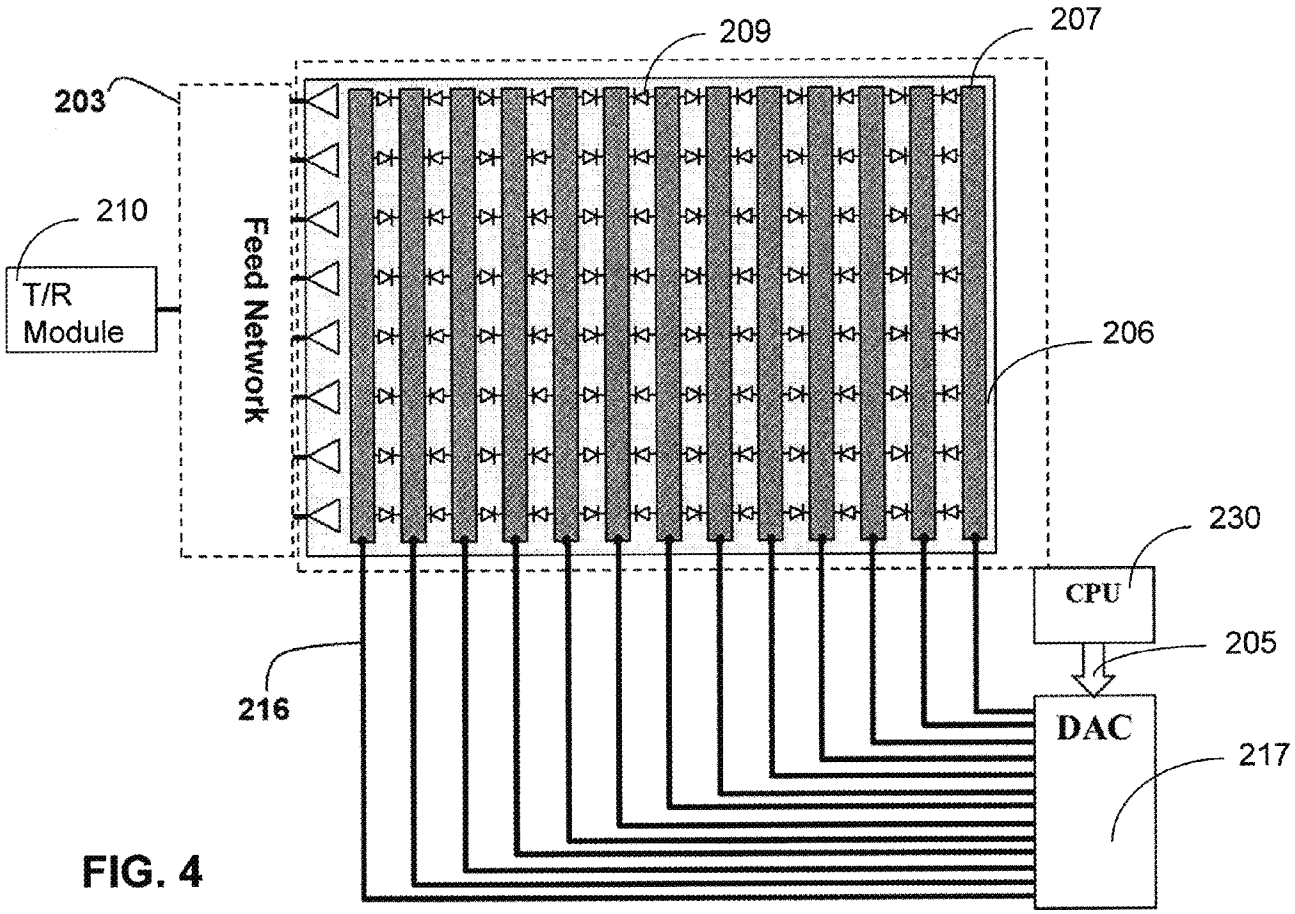
FIG. 4 shows another electronically steered artificial impedance surface antenna (AISA) in accordance with the present disclosure.

FIG. 4 shows another electronically steered artificial impedance surface antenna (AISA) in accordance with the present disclosure that is essentially the same as the embodiment described with reference to FIG. 2A, except in the embodiment of FIG. 4, a voltage is applied to each of the metallic strips 207 by voltage control lines 216. Twice as many control voltages are required compared to the embodiment of FIG. 2A, however, the spatial resolution of the impedance modulation is doubled. The voltage applied to each voltage control line 216 is a function of the desired theta (θ) angle, and may be different for each voltage control line 216. The voltages are applied from a digital-to-analog converter (DAC) 217 that receives digital controls 205 from an outside source, which may be a microprocessor, central processing unit (CPU) or any computer or processor, for steering in the theta direction.

Figure 1:
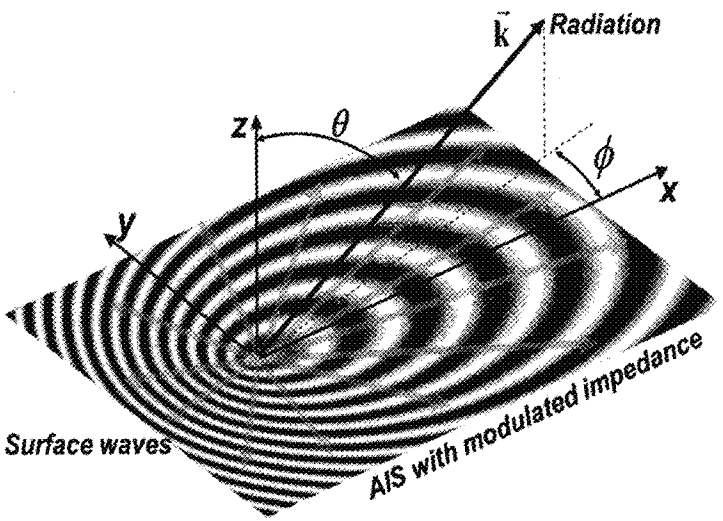
PRIOR ART FIG. 1
FIG. 1 shows surface waves propagating outward from a source interact with the modulated impedance to produce radiation in a narrow beam in accordance with the prior art.

The antenna main lobe is steered in the phi direction by using the feed network 203 to impose a phase shift between each of the RF SW feeds 208 in the same manner as described with reference to FIG. 1.

Figure 5:
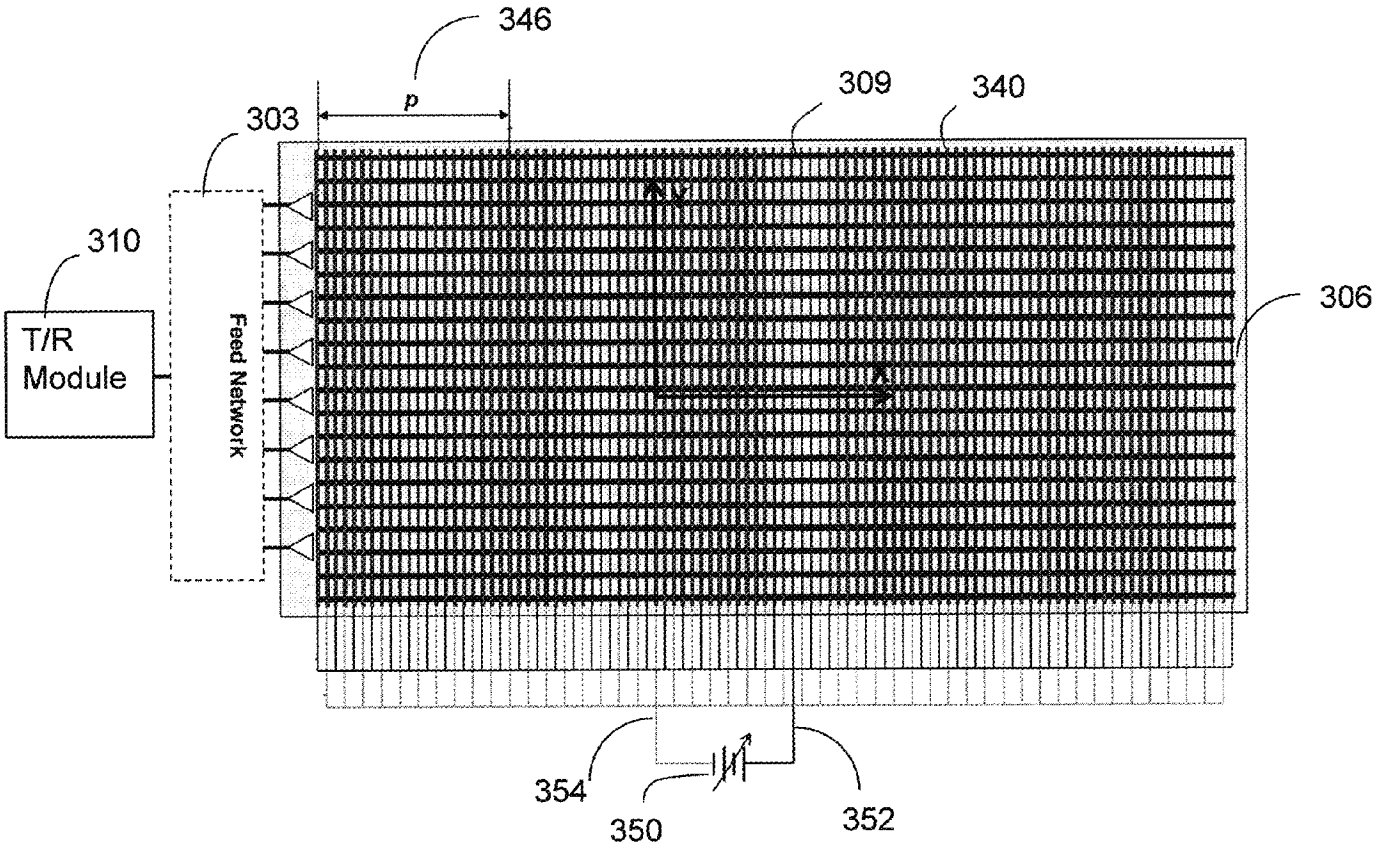
FIG. 5 shows yet another electronically steered artificial impedance surface antenna (AISA) in accordance with the present disclosure.

FIG. 5 illustrates a preferred embodiment where the theta θ angle control DACs 117 and 217 of FIGS. 2A and 4 are replaced by a single control voltage from a variable voltage source 350. As the voltage of variable voltage source 350 is varied, the AISA radiation angle varies between a minimum and maximum theta angle that is determined by the details of the AISA design. The voltage is applied though voltage control lines 352 and 354 to the metallic strips 340 on the surface of the AISA. Voltage control line 354 may be a ground with the voltage control line 352 being a variable voltage. Across the x dimension, the metallic strips 340 are alternately tied to voltage control line 352 or to voltage control line 354.

One or more varactors diodes 309 may be in each gap between adjacent metallic strips 340 and electrically connected to the metallic strips in the same manner as shown in FIG. 2A.

The metallic strips may have centers that are equally spaced in the x dimension, with the widths of the metallic strips 340 periodically varying with a period p 346. The number of metallic strips in a period 346 can be any number, although 10 to 20 is reasonable for most designs. The width variation is designed to produce surface-wave impedance with a periodic modulation in the X-direction with period p 346, for example, the sinusoidal variation of equation (8) above.

The surface-wave impedance at each point on the AISA is determined by the width of the metallic strips and the voltage applied to the varactors 309. The relation between the surface-wave impedance and these parameters is well understood and documented in the references [1]-[9].

The capacitance of the diode varactors 309 varies with the applied voltage. When the voltage is 0 volts, the diode capacitance is at its maximum value of $C_{max}$. The capacitance decreases as the voltage is increased until it reaches a minimum value of $C_{min}$. As the diode capacitance is varied, the impedance modulation parameters, X and M in Eqn. (8) vary also from minimum values $X_{min}$ and $M_{min}$ to maximum values of $X_{max}$ and $M_{max}$. Likewise, the mean surface-wave index of Eqn. (10) varies from $n_{min}=\sqrt{(X_{min}/377)^2+1}$ to $n_{max}=\sqrt{(X_{max}/377)^2+1}$.

Then from Eqn. (9), the range that the AISA's radiation angle can be scanned varies from a minimum of $$\theta_{min}=\sin^{-1}(n_{min}-\lambda/p) \quad (11)$$

to a maximum of $$\theta_{max}=\sin^{-1}(n_{max}-\lambda/p) \quad (12)$$

with variation of a single control voltage.

Figure 6:
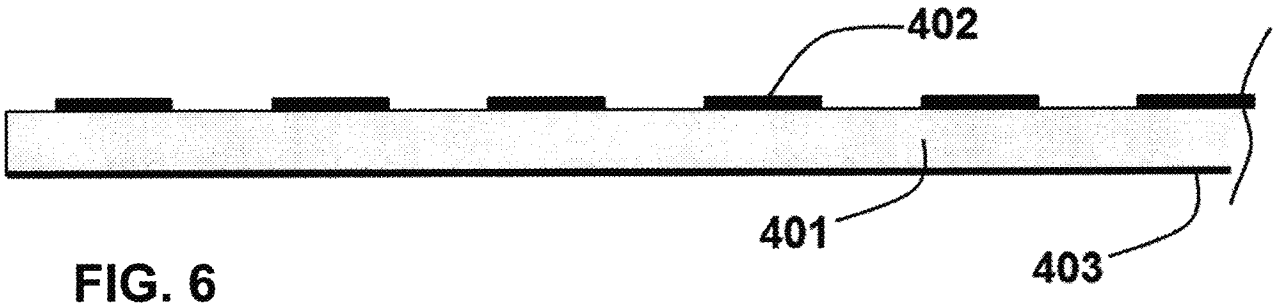
FIG. 6 shows another side elevation view of an AISA in accordance with the present disclosure.

In another embodiment shown in the elevation view of FIG. 6, the substrate 401, which may be used for dielectric substrates 106, 206 or 306, is a material whose electrical permittivity is varied with application of an electric field. As described above, no varactors 109, 209 or 309 are used in this embodiment. When a voltage is applied to metallic strips 402 on the AISA, an electric field is produced between adjacent strips and also between the strips and the substrate ground plane 403. The electric field changes the permittivity of the substrate material, which results in a change in the capacitance between adjacent metallic strips 402. As in the other embodiments, the capacitance between adjacent metallic strips 402 determines the surface-wave impedance.

Figure 7:
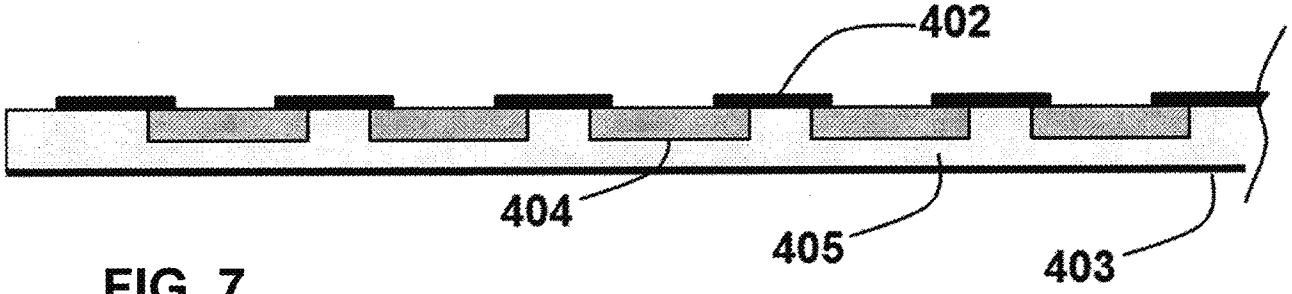
FIG. 7 shows yet another side elevation view of an AISA in accordance with the present disclosure.

In a variation on this, shown in the elevation view of FIG. 7, a voltage differential may be applied to adjacent metallic 402 strips, which creates an electric field between the metallic strips 402 and produces a permittivity change in a variable material 404 between the metallic strips 402. The variable material 404 may be any electrically variable material, such as liquid crystal material or barium strontium titanate (BST). It may be necessary, especially in the case of using liquid crystals, to embed the variable material 404 in pockets within an inert substrate 405, as shown in FIG. 7.

The antenna main lobe is steered in the phi direction by using the feed network 303 to impose a phase shift between each of the RF SW feeds 308 in the same manner as described with reference to FIG. 2A.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. An artificial impedance surface antenna having a primary gain lobe steerable in phi and theta angles comprising:

a dielectric substrate;

a plurality of metallic strips on a first surface of the dielectric substrate, the metallic strips spaced apart across a length of the dielectric substrate and each metallic strip extending along a width of the dielectric substrate;

surface wave feeds spaced apart along the width of the dielectric substrate near an edge of the dielectric substrate;

a first circuit coupled to the surface wave feeds for controlling relative phase differences between each surface wave feed, wherein the phi angle is controlled by the relative phase differences between each surface wave feed; and a second circuit coupled to the plurality of metallic strips for controlling voltages on each of the metallic strips, wherein the theta angle is controlled by the voltages on the plurality of metallic strips;

wherein the dielectric substrate is substantially in an X-Y plane defined by an X axis and a Y axis;

wherein the phi angle is an angle in the X-Y plane relative to the X axis; and wherein the theta angle is an angle relative to a Z axis orthogonal to the X-Y plane.

2. The artificial impedance surface antenna of claim 1 further comprising:

at least one tunable element coupled between each adjacent pair of metallic strips.

3. The artificial impedance surface antenna of claim 2 wherein:

the tunable element comprises a plurality of varactors coupled between each adjacent pair of metallic strips.

4. The artificial impedance surface antenna of claim 3 wherein:

each respective varactor coupled to a respective metallic strip has a same polarity of the respective varactor coupled to the respective metallic strip.

5. The artificial impedance surface antenna of claim 2 wherein:

the tunable element comprises an electrically variable material between adjacent metallic strips.

6. The artificial impedance surface antenna of claim 5 wherein:

the electrically variable material comprises a liquid crystal material or barium strontium titanate (BST).

7. The artificial impedance surface antenna of claim 5 wherein:

the dielectric substrate is an inert substrate; and the electrically variable material is embedded within the inert substrate.

8. The artificial impedance surface antenna of claim 1 wherein:

the surface wave feeds are configured so that a relative phase difference between each surface wave feed determines the phi angle for a primary gain lobe of the electronically steered artificial impedance surface antenna (AISA).

9. The artificial impedance surface antenna of claim 8 further comprising:

a radio frequency (RF) feed network coupled to the surface wave feeds.

10. The artificial impedance surface antenna of claim 9 wherein the radio frequency (RF) feed network comprises:

a transmit/receive module;

a plurality of phase shifters, respective phase shifters coupled to the transmit/receive module and to a respective surface wave feed; and a phase shift controller coupled to the phase shifters.

11. The artificial impedance surface antenna of claim 1 wherein:

alternating metallic strips of the plurality of metallic strips are coupled to a ground; and each metallic strip not coupled to ground is coupled to a respective voltage from a voltage source;

wherein the surface wave impedance of the dielectric substrate is varied by changing the respective voltages.

12. The artificial impedance surface antenna of claim 1 wherein:

each metallic strip is coupled to a voltage source;

wherein the surface wave impedance of the dielectric substrate is varied by changing the respective voltages applied from the voltage source to each respective metallic strip.

13. The artificial impedance surface antenna of claim 1 further comprising:

a ground plane on a second surface of the dielectric substrate opposite the first surface of the dielectric substrate.

14. The artificial impedance surface antenna of claim 1 wherein:

the metallic strips have centers spaced apart by a fraction of a wavelength of a surface wave propagated across the dielectric substrate; and wherein the fraction is less than or equal to 0.2.

15. The artificial impedance surface antenna of claim 14 wherein:

the tunable elements are varactors; and a spacing between adjacent varactors coupled between two adjacent metallic strips is approximately the same as the spacing between centers of adjacent metallic strips.

16. The artificial impedance surface antenna of claim 1 wherein:

the artificial impedance surface antenna has a surface-wave impedance $Z_{sw}$, that is modulated or varied periodically by applying voltages to the metallic strips such that at distance (x) away from the surface wave feeds the surface wave impedance varies according to:

$$Z_{sw}=X+M\cos(2\pi x/p)$$

where X and M are a mean impedance and an amplitude of modulation respectively, and p is a modulation period; and the theta angle is related to the surface wave impedance modulation by $$\theta=\sin^{-1}(n_{sw}-\lambda/p)$$

where λ is a wavelength of a surface wave propagated across the dielectric substrate, and $$n_{sw}=\sqrt{(X/377)^2+1}$$

is a mean surface-wave index.

17. An artificial impedance surface antenna having a primary gain lobe steerable in phi and theta angles comprising:

a dielectric substrate;

a plurality of metallic strips on a first surface of the dielectric substrate, the metallic strips spaced apart across a length of the dielectric substrate, the metallic strips having equally spaced centers, the metallic strips periodically varying in width with a period of p, and each metallic strip extending along a width of the dielectric substrate;

a first circuit coupled to the surface wave feeds for controlling relative phase differences between each surface wave feed, wherein the phi angle is controlled by the relative phase differences between each surface wave feed; and a second circuit coupled to the plurality of metallic strips for controlling voltages on each of the metallic strips, wherein the theta angle is controlled by the voltages on the plurality of metallic strips;

surface wave feeds spaced apart along a width of the dielectric substrate near an edge of the dielectric substrate;

wherein the dielectric substrate is substantially in an X-Y plane defined by an X axis and a Y axis;

wherein the phi angle is an angle in the X-Y plane relative to the X axis; and wherein the theta angle is an angle relative to a Z axis orthogonal to the X-Y plane.

18. The artificial impedance surface antenna of claim 17 further comprising:

at least one tunable element coupled between each adjacent pair of metallic strips.

19. The artificial impedance surface antenna of claim 18 wherein:

the tunable element comprises a plurality of varactors coupled between each adjacent pair of metallic strips; and each respective varactor coupled to a respective metallic strip has a same polarity of the respective varactor coupled to the respective metallic strip.

20. The artificial impedance surface antenna of claim 18 wherein:

the tunable element comprises an electrically variable material between adjacent metallic strips.

21. The artificial impedance surface antenna of claim 20 wherein:

the electrically variable material comprises a liquid crystal material or barium strontium titanate (BST).

22. The artificial impedance surface antenna of claim 20 wherein:

the dielectric substrate is an inert substrate; and the electrically variable material is embedded within an inert substrate.

23. The artificial impedance surface antenna of claim 17 wherein:

the surface wave feeds are configured so that a relative phase difference between each surface wave feed determines the phi angle for a primary gain lobe of the electronically steered artificial impedance surface antenna (AISA).

24. The artificial impedance surface antenna of claim 17 further comprising:

a ground plane on a second surface of the dielectric substrate opposite the first surface of the dielectric substrate.

25. The artificial impedance surface antenna of claim 17 wherein:

alternating metallic strips of the plurality of metallic strips are coupled to a first terminal of a variable voltage source; and each metallic strip not coupled to the first terminal is coupled to a second terminal of the variable voltage source;

wherein the surface wave impedance of the artificial impedance surface antenna is varied by changing a voltage between the first and second terminals of the variable voltage source.

26. The artificial impedance surface antenna of claim 17 further comprising:

a radio frequency (RF) feed network coupled to the surface wave feeds.

* * * * *